US007008590B1

(12) United States Patent
Maskell

(10) Patent No.: US 7,008,590 B1
(45) Date of Patent: Mar. 7, 2006

(54) REFRACTORY STOPPER WITH A TEMPERATURE RESISTANT, ELECTRICALLY CONDUCTIVE COATING

(76) Inventor: Thomas Joseph Maskell, 2585 Spitler Rd., Poland, OH (US) 44514

( * ) Notice: Subject to any disclaimer, the term of this patent is extended or adjusted under 35 U.S.C. 154(b) by 39 days.

(21) Appl. No.: 10/717,164

(22) Filed: Nov. 19, 2003

Related U.S. Application Data

(60) Provisional application No. 60/447,982, filed on Feb. 18, 2003.

(51) Int. Cl.
*C21D 11/00* (2006.01)

(52) U.S. Cl. ..... 266/78; 222/601; 222/602

(58) Field of Classification Search ..... 222/590, 222/597, 601, 602; 266/78
See application file for complete search history.

(56) References Cited

U.S. PATENT DOCUMENTS

| | | | | |
|---|---|---|---|---|
| 3,948,812 | A | | 4/1976 | Corren |
| 4,064,074 | A | | 12/1977 | Ellis |
| 4,487,733 | A | | 12/1984 | Palilla |
| 4,617,237 | A | | 10/1986 | Gupta |
| 4,630,667 | A | * | 12/1986 | LaBate ..... 164/363 |
| 4,686,116 | A | * | 8/1987 | Rickborn et al. ..... 427/215 |
| 5,182,165 | A | | 1/1993 | Clough |
| 6,086,791 | A | | 7/2000 | Miller |

* cited by examiner

*Primary Examiner*—Scott Kastler

(57) ABSTRACT

A refractory article such as a stopper used in the casting of molten metals that consists of a refractory core coated with an electrically conductive layer of carbon and graphite materials such that the stopper withstands the mechanical, chemical and thermal rigors of the casting operation and provides an effective electrical contact during the molten metal casting process.

10 Claims, 4 Drawing Sheets

REFRACTORY STOPPER WITH A TEMPERATURE RESISTANT, ELECTRICALLY CONDUCTIVE COATING

CROSS-REFERENCE TO RELATED APPLICATIONS

This application claims the benefit of Provisional Patent Application Ser. No. 60/447,982 filed 2003 Feb. 18.

FEDERALLY SPONSORED RESEARCH

Not Applicable

SEQUENCE LISTING OR PROGRAM

Not Applicable

BACKGROUND OF THE INVENTION

1. Field of Invention

This invention relates to refractory articles such as stoppers that are used as electrical contacts in molten metal casting processes.

2. Background of the Invention

Foundry systems are more complex and technically demanding. The refractories used in them are required to fulfil numerous functions in the metal casting process. One function is to provide a container in which the metal to be cast is melted. Another is to contain the molten metal prior to casting. Still, another is to direct the flow of the molten metal during casting. And, the molds into which the molten metal is poured are also made of refractories. These functions are achieved with a system of refractory vessels, sprouts, channels, nozzles, sliding valves, stoppers or molds. The refractory articles used and their arrangement depends on the design of the molten metal casting system and the corrosiveness of the metal being poured.

Regardless of the system design, the refractories have similar performance requirements. They must be mechanically strong. They must have high temperature softening and melting points. They must resist thermal shock. They must be resistant to the corrosion and erosion of the molten metal. They must not contaminate the metal being poured. They must be economical to make and use. And they must not pollute the environment during use or upon disposal.

Oxides of silicon, zirconium and aluminum have proven to be effective foundry refractories. They are used separately or in combination to form mixed oxide materials such as mullite, fireclay and zircon. These oxides provide low-cost solutions to many foundry casting problems.

Other materials such as graphite and silicon carbide can also be used. These materials are more expensive than their oxide counterparts. They are limited to special applications where the system's requirements justify the added expense. For instance, graphite is used to produce permanent molds. Because of graphite's unique properties of high thermal conductivity and non wetting by molten metals, the use of the more expensive graphite material in molds is justified. Non wetting means that the molten metal does not penetrate or stick to the material's surface. This increases the life of the mold.

A new foundry casting system has been developed that requires that the refractory stopper used to control the flow of the molten metal also conduct electricity. The refractory stopper must provide an electrical link between electrically charged elements of the system. In essence, the refractory stopper must become an electrical switch. This places a new demand on the refractory.

Because refractory oxides, such as silica, alumina, and mullite do not conduct electricity, this proprietary foundry system requires that its stoppers be made from a different refractory material. Since carbon and graphite does conduct electricity, these materials are used to make the stopper. However, the carbon and graphite refractories present the user with new problems.

The first problem is the added expense of using a carbon or graphite. These materials are much more expensive than traditional oxide based refractory materials such as fireclay, kaolin and bauxite. The added cost of the raw material adds to the final cost of the refractory stopper. And unlike permanent molds which are used repeatedly, stoppers are only used once and discarded. Thus, the higher cost is more difficult to justify.

Also, the carbon and graphite materials require more expensive processing techniques. Carbon and graphite oxidize above 950 degrees Fahrenheit. These stoppers are fired at temperatures above 2000 degrees Fahrenheit. They require a controlled atmosphere fire to prevent them from oxidizing. Refractory producers achieve this by placing them in closed containers during firing. Any air leakage into these containers causes the carbon-graphite stoppers to oxidize. This depletes the carbon-graphite and destroys the surface integrity of the stopper.

In addition, most graphite and carbon materials are imported into the United States. Oxide materials such as bauxite and fireclay are readily mined and processed in the United States. This lack of domestic sources could create a shortage of the graphite materials in the U.S. which would seriously curtail the foundry's operation. It is a significant risk factor for foundry planners.

Also, there are fewer refractory producers willing to make carbon and graphite refractory products. Many refractory producers do not have the proper equipment to handle carbon-based materials. Others do not want the added expense of keeping the carbon materials separated from their other product lines. The carbon and graphite materials could contaminate their standard refractory product lines. Fewer producers mean less competition. This creates higher prices. It also could create future shortages if a supplier is shutdown because of labor unrest, natural disasters or financial difficulties.

Finally, the pure carbon or graphite or blended (i.e., carbon-graphite) stopper tends to prematurely solidify the molten metal during the casting operation. This is caused by the very high thermal conductivity of carbon and graphite. This cools the molten metal before the casting operation is completed. This chilling effect creates defects in the final metal casting.

Some of the problems created by the use of a pure carbon-graphite stopper can be reduced by adding clay to the pure carbon-graphite stopper. For instance, the high thermal conductivity of a pure carbon or graphite stopper can be reduced by adding clay to the stopper. This creates a clay-graphite stopper. The clay-graphite stopper has a lower thermal conductivity because the clay has a lower thermal conductivity than either the carbon or the graphite. In effect, the clay addition dilutes the conductivity of the pure graphite stopper.

A clay addition also reduces the cost of the composition because of the much lower cost of clay versus the carbon and graphite raw materials. Depending on the clay used, the cost could be one tenth that of carbon or graphite.

Other problems are also alleviated when clay is added to the carbon-graphite stopper. It strengthens the stopper. This makes it more resistant to mechanical failures and handling defects. It reduces the carbon-graphite content. Thus, the clay-graphite refractory is less dependent on imported raw materials. It also improves the processing characteristics of the material making the stopper easier and cheaper to produce.

However, the clay-graphite composition did not alleviate all the problems of the carbon-graphite composition. For instance, the number of companies willing to produce the clay-graphite stopper is still limited. Whether it is a pure or partial carbon-graphite stopper, the risk of contamination is still present. In addition, the clay-graphite stopper still requires controlled atmosphere firing since it still has a significant graphite content.

In fact, the addition of clay makes the controlled atmosphere firing even more important. Even minor amounts of surface oxidation renders the stopper useless as an electrical contact which is its primary electrical purpose. This occurs because the oxidation of the carbon and graphite at the surface of the clay-graphite stopper exposes only the non conductive clay structure. Thus, the surface of the stopper has the electrical properties of the clay rather than that of the carbon-graphite or clay-graphite surfaces.

Finally, the clay-graphite is a cost improvement, but it is still not as economical as an oxide-based stopper. The amount of carbon and graphite used in a clay-graphite stopper is typically between 35 and 60 percent of the composition, by weight. The cost of the graphite can be 5 to 10 times greater than the cost of the clay component. Thus, the raw materials in the clay-graphite stopper remain significantly more expensive than those of a pure clay or oxide-based stopper. Also, the processing of the stopper remains more costly because of the graphite content.

Thus, the clay-graphite solution still suffers from many of the problems facing the pure carbon-graphite composition.

1) It still contains a high percentage of the more expensive carbon and graphite materials.
2) It still contains a high percentage of the carbon and graphite materials that are, at times, imported and in limited supply.
3) It still requires controlled atmosphere firing which increases its cost of manufacture.
4) It is more prone to surface oxidation during firing which increases product scrap and costs and can render the stopper useless as an electrical contact element.
5) It is still only available from a limited number of refractory suppliers because it still has a significant graphite content and can contaminate their other products.

BACKGROUND OF INVENTION—OBJECTS AND ADVANTAGES

My refractory stopper eliminates or alleviates all of the problems left unsolved by the existing and prior art.

First, it satisfies the primary requirement that the refractory be capable of providing an electrical contact point with the mechanism. It achieves this with an electrically conductive coating. The coating is applied to a low-cost, prefired, refractory oxide stopper. Thus, the stopper has the refractory properties of an oxide stopper and the electrical conductivity of a graphite stopper.

The coating consists of, but is not limited to, a commercially available electrically conductive graphite or carbon or a blend of the two in an aqueous suspension. A high-fusion-point, plastic clay, such as bentonite, is added to this suspension. Other binders, deflocculants and fluxes are also added. The exact formulation of the suspension plus additives depends on the refractory article being coated, the electrical conductivity requirements of the casting system and the method used to place the coating on the refractory.

The coating is designed to be cured and/or bonded to the refractory article at temperatures below 950 degrees Fahrenheit. Thus, the coated refractory is not fired at high temperatures. There is no need for controlled atmospheres. This makes the manufacturing process is less energy intensive and less expensive.

The refractory stopper receiving the coating can be made of traditional refractory materials such as mullite, silica, alumina or fireclay. These prefired, oxide-based refractories are obtained from many different refractory producers in the United States and around the world. They are inexpensive and easy to produce. They are designed and formulated to withstand the mechanical and thermal rigors of the metal casting process.

The carbon-graphite coating is applied to this traditional oxide stopper by traditional ceramic glazing techniques such as dipping, brushing or spraying. The coating is dried in air at room temperature, or at higher temperatures, if desired, but is not cured at temperatures above 950 degrees Fahrenheit. This eliminates special equipment or special skills on the part of the manufacturer. Thus, the coating can be applied by the refractory producer or the foundry or by a third party. This provides the foundry with several sourcing options.

Once it is coated, the oxide stopper is now ready for use in the metal casting mechanism. Its carbon-graphite coating will conduct electricity, and its inner oxide core will withstand the thermal and mechanical rigors of the casting operation.

My refractory stopper solves many of the problems inherent in both the carbon-graphite and clay-graphite stopper. It allows the customer to use an inexpensive refractory stopper made of traditional oxide based refractory materials such as fireclay. It places the graphite on the surface of the stopper where it is needed to conduct electricity and provide for an electrical contact. The composition of the coating is designed so that it withstands traditional metal casting temperatures of 2500 degrees Fahrenheit yet does not have to be cured above 950 degrees Fahrenheit. And, its composition will not contaminate or adversely affect the molten metal being cast. Thus, the foundry gets an inexpensive, readily available, refractory stopper that is capable of completing an electric circuit.

BACKGROUND OF INVENTION—PRIOR ART

The refractory and electrical properties of carbon and graphite are well known. In the electrical field, carbon is used as an electrical conductor in motors and generators. These systems require that the carbon be maintained at temperatures below 950 degrees Fahrenheit. Above 950 degrees Fahrenheit the carbon begins to oxidize rapidly. This tendency to oxidize generally restricts carbon based electrical devices to lower temperature environments.

However, carbon is used as heating elements in resistance heaters. Heating elements generate heat as electricity passes through them. As long as the temperature of the graphite element is below 950 degrees Fahrenheit, it does not oxidize. Above 950 degrees Fahrenheit, the carbon-graphite elements must be protected from oxygen. This is usually done with an impervious coating that seals the surface of the element and prevents oxygen from contacting it.

In metal melting, carbon materials are fabricated into large electrodes which are used to melt steel in electric arc furnaces. These electrodes conduct electricity. An electric arc is then created at the tip of the electrode just above the solid metal to be melted. The intense heat of the electric arc melts the solid metal. However, the carbon electrodes are consumed during the melting process because of the oxygen and high heat environment. They are routinely replaced.

As a refractory, carbon and graphite are used in the metal melting field. Their high melting point (refractoriness), high thermal conductivity and non wetting characteristics (when in contact with molten metal) makes them useful refractories. They are usually fabricated into stoppers and nozzles. These are then used to control the flow of molten metals during molten metal casting operations. Also, because carbon and graphite can be easily machined, they are also used to produce semipermanent foundry molds for the casting of metal shapes.

If it wasn't for carbon and graphite's tendency to oxidize, it would be an ideal foundry refractory material. However, above 950 degrees Fahrenheit carbon-based materials oxidize rapidly. This limits their use as both an electrical material and a refractory material. In both uses, when carbon containing products are used for long periods of time above 950 degrees Fahrenheit, they must be protected from oxygen containing atmospheres. This is usually accomplished with an impervious coating. When used as a refractory, protecting carbon from oxidation is a very daunting task because most coatings become ineffective at the high temperatures inherent in a refractory application.

While protective coatings reduce the oxidation of carbon-graphite refractories, they also reduce the value of the carbon-graphite as an electrical contact. In order for the carbon to act as an electrical contact, the carbon-graphite cannot be sealed with a non conductive material. The coatings used to protect carbon are usually ceramic-based and non conductive. Thus, while these protective sealants do not limit the electrical conductivity of the underlying material, they do prevent their use as an electrical contact. Electrical contacts require a clean, conductive surface.

For instance, Miller (U.S. Pat. No. 6,086,791) describes a carbon-graphite coating used to generate heat up to temperature as high as 850 degrees centigrade (1562 degrees Fahrenheit). The actual purpose of the coating was not to produce an electrically conductive layer, but to create a heat generating coating similar to a heating element. This was achieved because heat was generated in the carbon-graphite layer as electricity passes through it. The coating was apparently protected from oxidation with an organic binder. The invention specified a maximum use temperature of 1562 degrees Fahrenheit. This would appear to preclude its use at molten metal temperatures of 2500 degrees Fahrenheit and higher. Also, since the surface was sealed to preclude oxygen contact with the carbon, it would also preclude it as an electrical contact.

This is also true of the invention described by Ellis (U.S. Pat. No. 4,064,074). Its indicated use temperature is well below the casting temperatures of most ferrous metals, but higher than the 950 degree Fahrenheit point of accelerated oxidation. It was designed as a heating element. Its composition also contained materials such as zinc oxide which could contaminate a ferrous metal casting.

In keeping with the use of carbon and graphite as an electrical resistance heater, Palilla (U.S. Pat. No. 4,487,733) points out that graphite-ceramic blends used to make electrodes can have their surfaces rendered non conductive by firing them in air and oxidizing the carbon and graphite off the surface. This creates a carbon depleted surface layer of non conductive ceramic material. This is the very firing problem that was noted with the clay-graphite stoppers. Loss of carbon and graphite on the surface changes the electrical contact capability of the stopper and is a persistent processing problem. These stoppers are often rejected, which increases their cost of production.

Materials other than carbon and graphite have been used to produce electrically conductive coatings which can be used at high temperatures but these inventions demonstrate one of the problems this invention seeks to avoid or eliminate. For instance, Clough (U.S. Pat. No. 5,182,165) describes a tin oxide composition, but tin oxide is thermodynamically less stable than most ferrous alloys. It would react with an aggressive molten ferrous alloy. This would cause the tin oxide to be reduced to its elemental form. The low melting point tin would be dissolved into the molten metal and contaminate it. Even without a reaction, the tin oxide decomposes at approximately 2000 degrees Fahrenheit, well below the melting point of most ferrous alloys. This decomposition would also release elemental tin into the ferrous alloy.

Similar contamination and melting point problems are present with Gupta (U.S. Pat. No. 4,617,237). He describes a metal silicide and silicon based electrically conductive film which is fired to 950 degrees Centigrade (1742 degrees Fahrenheit). Also, to preserve the elemental silicon in the composition, this firing is in a controlled atmosphere, free of oxygen. This is the same problem facing the producers of clay-graphite refractories.

Finally, Corren (U.S. Pat. No. 3,948,812) describes a glassy conductive coating made from a complex blend of glass forming frits, boron, chromium, tungsten, molybdenum and other electrically conductive metal alloys and silicides. The glass is fired at temperatures between 800 and 1350 degrees centigrade and is design to be used at temperatures of 1000 degrees centigrade (1832 degrees Fahrenheit). This formulation will not withstand ferrous casting temperatures. Its complex composition provides many elements that can contaminate the molten metal. It is also processed (fired) at high temperatures, and its complex composition could raise environmental issues since it contains elements such as chromium.

The prior art has focused on the use of carbon and graphite as electrical conductors or heat generating resistance elements. These applications are generally limited to temperatures below 950 degrees Fahrenheit where oxidation of the carbon and graphite is not a limiting factor. When carbon and graphite are used above 950 degrees Fahrenheit, the carbon elements are surface sealed with an impervious coating to protect them from oxygen. These coatings are composed of ceramic, glass or high temperature organic compounds. While protecting the elements from oxygen, these coatings also prevent the surfaces from making electrical contact and providing an electrical linkage within a casting system. They also create a source of contamination in a metal casting environment. When materials other than carbon and graphite are considered, the oxidation problem is eliminated, but the risk of contamination is significantly increased. These materials are less stable at metal casting temperatures and unstable in contact with molten metal alloys.

SUMMARY

In accordance with the present invention an electrically insulating refractory oxide core is coated with an electrically conductive carbon-graphite coating so that it can be used as both an electrical contact point and a molten metal flow control component of the molten metal casting mechanism. The advantages of this coated stopper to the present and prior art are:

1) Its traditional oxide refractory core:
   a) is composed of less expensive refractory materials,
   b) is composed of materials more readily available in the United States,
   c) does not require non oxidizing firing environments,
   d) does not require special handling or equipment,
   e) is cheaper to produce,
   f) and can be obtained from many refractory suppliers in the United States and around the world.
2) The electrically conductive coating:
   a) contains about one hundredth the amount of carbon-graphite than the present clay-graphite stopper,
   b) can be applied by traditional glazing techniques such as dipping, brushing and spraying,
   c) can be dried or cured below 950 degrees Fahrenheit,
   d) does not require special equipment or atmospheres to dry or cure the coating,
   e) allows the present producers of clay-graphite stoppers to recover their oxidized products that would normally be scrapped,
   f) could be applied to the refractory core by the customer as well as a private contractor or the refractory core producer,
   g) will withstand the high temperatures of a molten metal contact environment such as a ferrous alloy casting operation,
   h) will not contaminate the molten metal being cast,
   i) will not contaminate the environment during use or upon disposal,
   j) and its surface is not sealed so that it can provide an electrical contact and link between electrified components in the system.

DRAWINGS—FIGURES

DRAWINGS—REFERENCE NUMERALS

Figure 1:
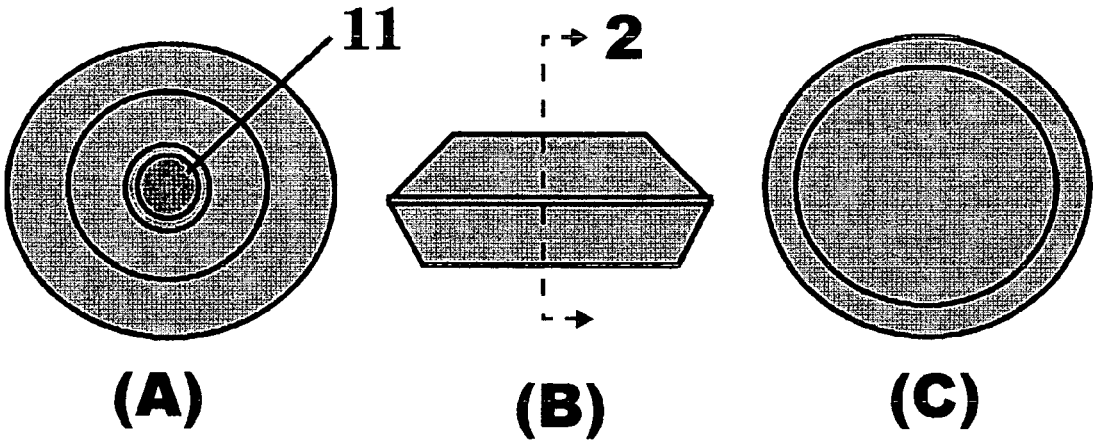
FIGS. 1A to 1C show various views of a coated refractory stopper.

11 Stopper mounting hole
12 Electrically conductive coating
13 Refractory core
14 Molten metal containment vessel
15 Stopper mounting rod
16 Electrical charge
17 Coated refractory Stopper
18 Electrical charge traveling over the stopper to the stopper mounting rod
19 Mechanical force pushing the stopper into the vessel to close the vessel

DETAILED DESCRIPTION OF DRAWINGS

FIG. 1 shows the top view (A), the side view (B) and the bottom view (C) of a refractory stopper coated with an electrically conductive coating. The refractory illustrated is a foundry stopper and has a hole (11) in the top that allows it to be mounted on a ceramic or metal rod by inserting the rod in the hole. The hole depth is about one half that of the stopper thickness.

Many different refractory and stopper designs are in use. This illustration is not intended to limit the application of the invention to any particular refractory or stopper design.

Figure 2:
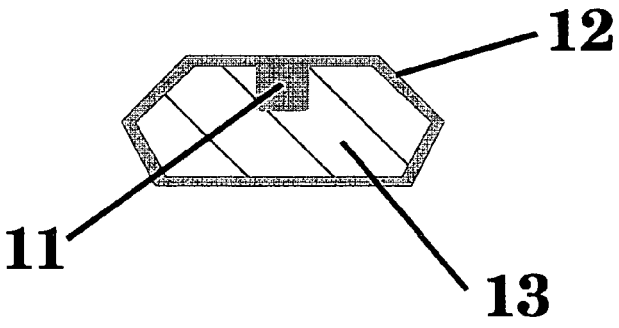
FIG. 2 shows a cross section of a coated refractory stopper.

FIG. 2 is a cross section view of the refractory stopper showing the electrically conductive coating (12) on the refractory core (13). The coating closely adheres to the refractory core and covers the entire surface including the interior of the hole (11).

Figure 3A:
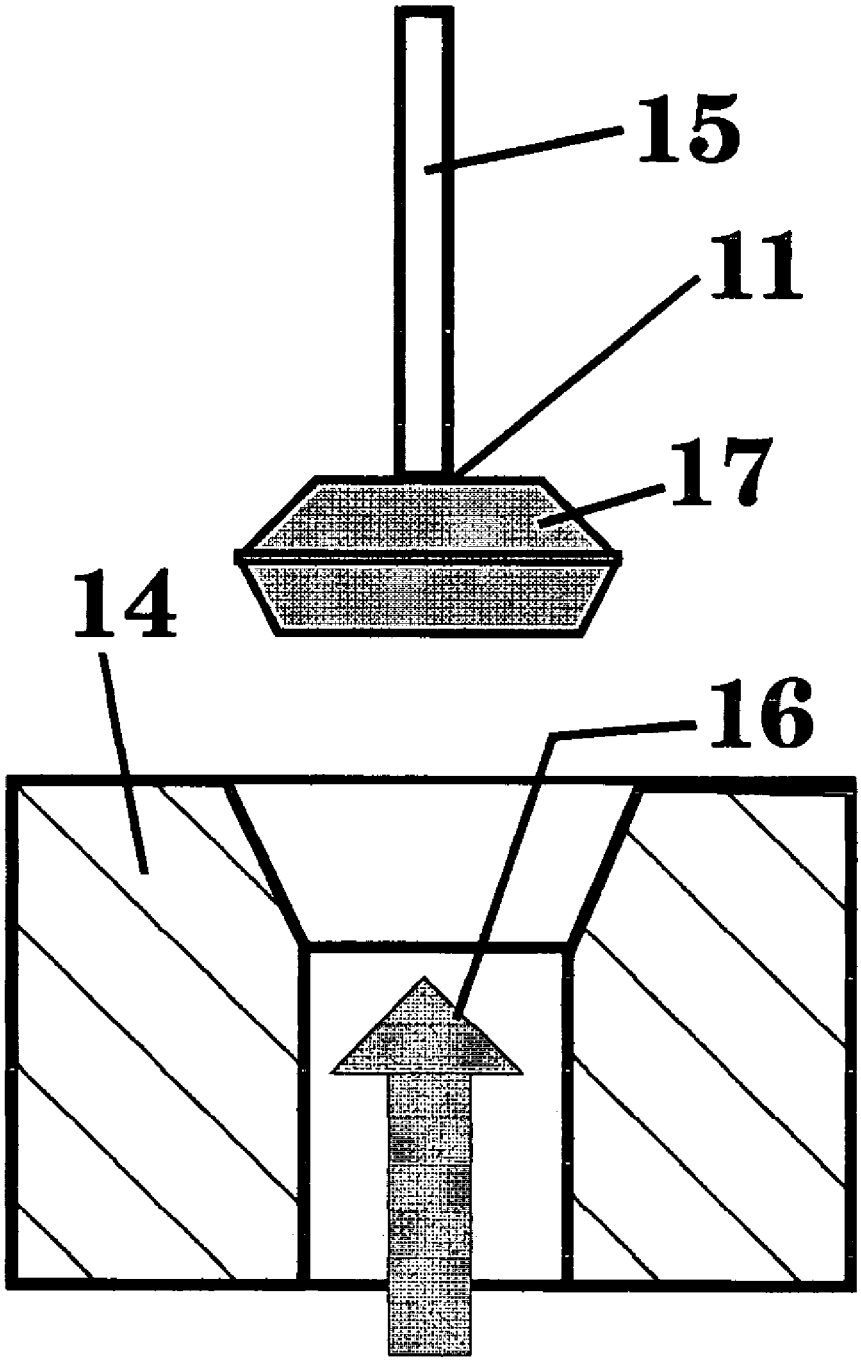
FIGS. 3A to 3C show the application of a refractory stopper in a metal casting mechanism.

FIG. 3 illustrates how the refractory stopper can be used in a simple molten metal casting mechanism. In FIG. 3A, the mechanism would be in the open position. The stopper (17) is affixed to the mounted rod (15) which is or contains an electrically conductive element. The mounting rod is designed such that the electrically conductive aspect of the rod is in intimate contact with the electrically conductive coating on the stopper (17). At this point, there is no contact between the electrically charged element in the system (16) and the stopper. In this example, the electrically charged element (16) is the molten metal rising through the containment vessel (14).

Figure 3B:
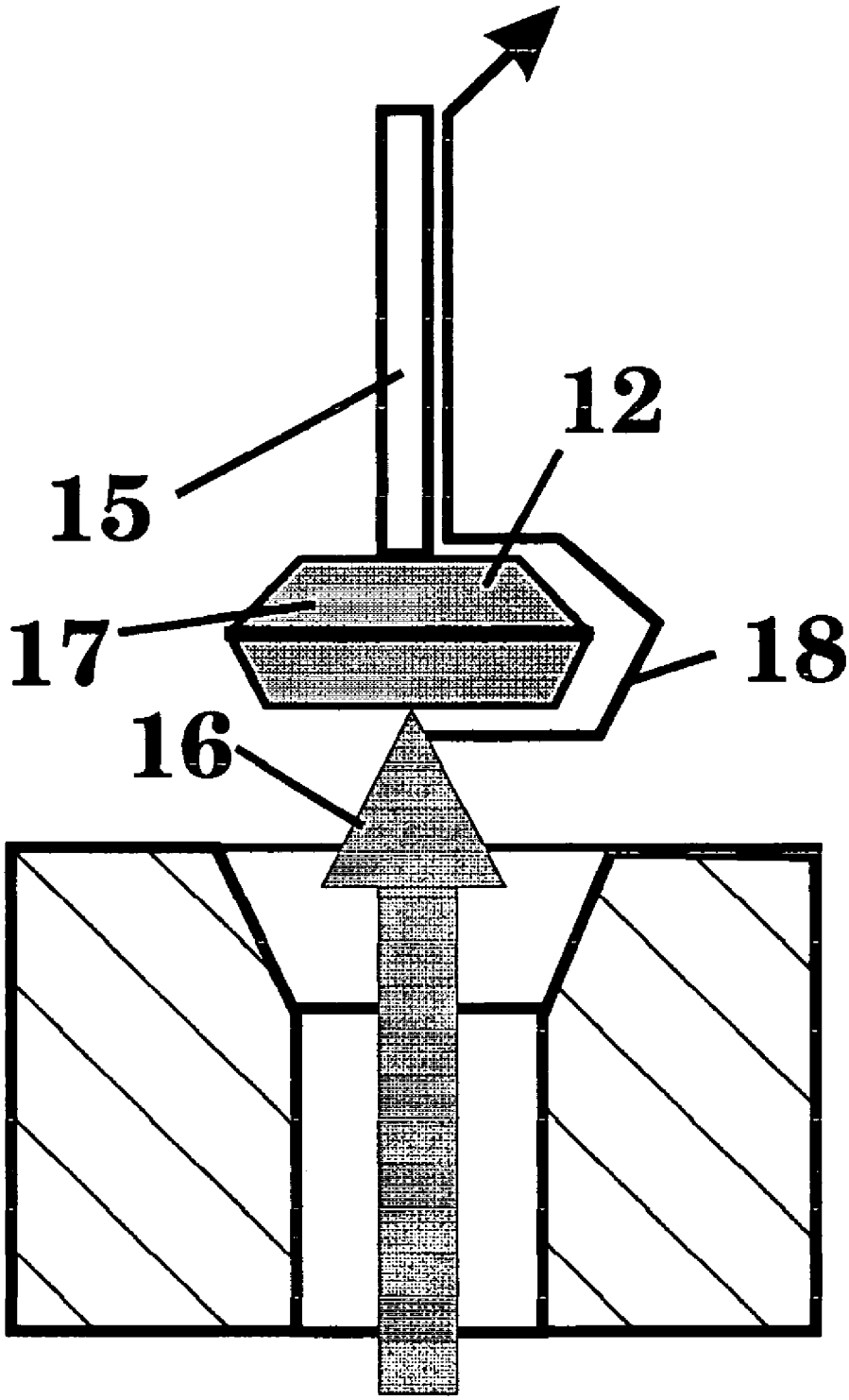

In FIG. 3B, the electrically charged element (16) in the system makes contact with the bottom of the refractory stopper (17) and sends an electrical charge (18) through the conductive coating (12) to the mounting rod (15) which is connected to a controller (not shown). Upon receipt of the electrical signal, the controller can be used to initiate one or many actions such as starting a timer, adding an alloying element to the molten metal, spinning the mold, etc. The action(s) initiated depends on the process, the product and the design of the mechanism.

Figure 3C:
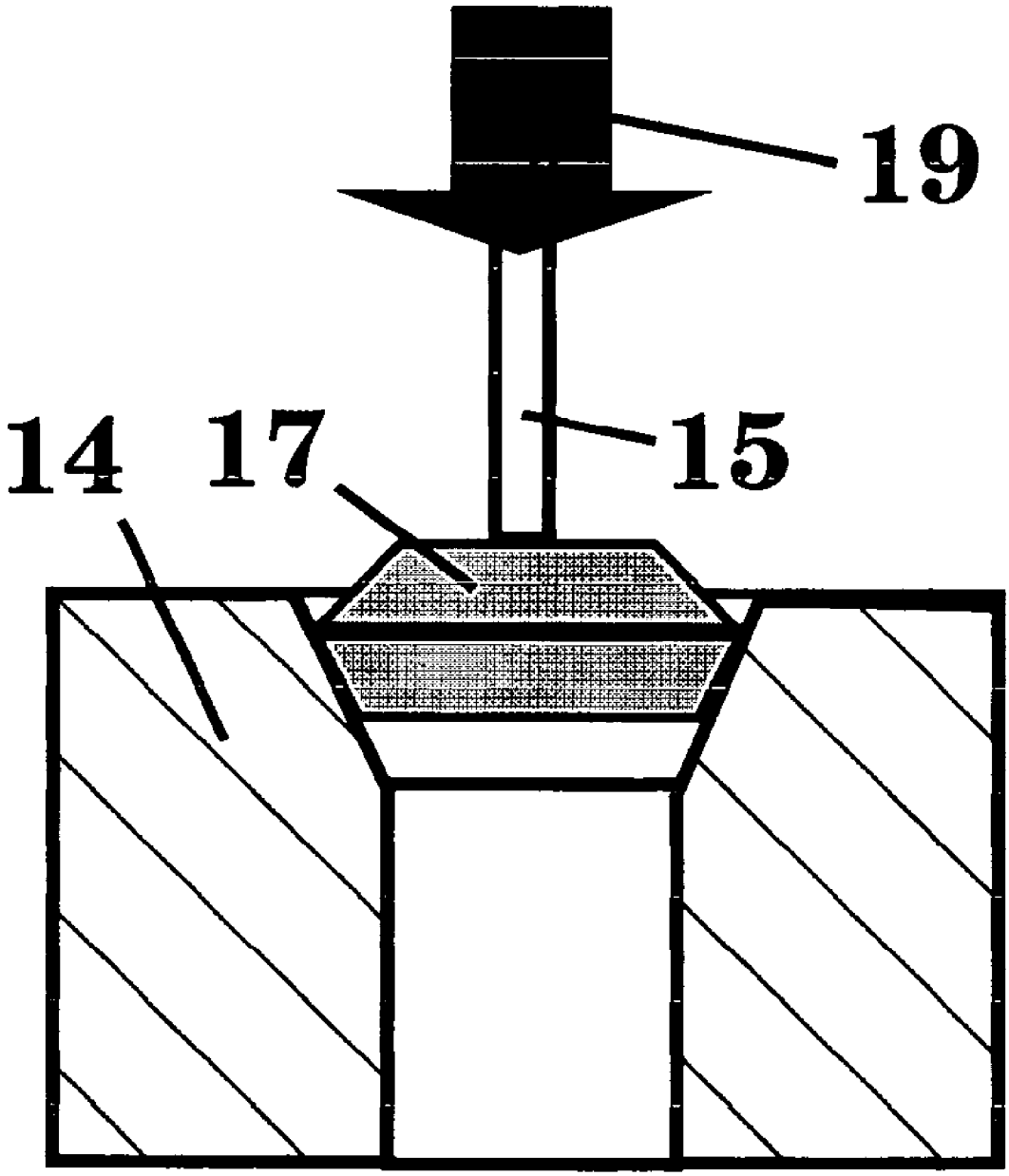

In FIG. 3C, the action illustrated is the closing of the molten metal containment vessel (14) by applying a mechanical force (19) on the mounting rod (15) which pushes the refractory stopper (17) into the opening in the molten metal containment vessel (14).

Although the description above contains many specifics, these should not be construed as limiting the scope of the invention, but merely providing illustrations of one of the preferred uses and embodiments of this invention. For instance, the refractory shape could be a nozzle with a series of conductive rings painted on its inner diameter which could be used to measure the level of molten metal in the nozzle. Or the stopper could be coated with a functional pattern rather than a total surface treatment. The functional pattern might reduce the coating material required without reducing the ability of the electrically conductive stopper to function as an electrical contact device.

Thus, the scope of the invention should be determined by the appended claims and their legal equivalents, rather than by the examples given.

I claim:

1. A composite refractory stopper used to control the flow of molten metal consisting of
   a) a refractory core composed of ceramic materials,
   b) a means for conducting an electric current on the surface of said refractory core, and
   c) a means for electrically connecting said means for conducting an electric current to an electrically activated control means such that said electrically activated control means can beneficially affect the flow of said molten metal.

2. The composite refractory stopper in claim 1 wherein said refractory core is essentially composed of ceramic oxides.

3. The composite refractory stopper in claim 1 wherein said refractory core is essentially composed of metal carbides.

4. The composite refractory stopper in claim 1 wherein said refractory core is essentially composed of a combination of ceramic oxides, metal carbides and elemental carbon.

5. The composite refractory stopper in claim 4 wherein said elemental carbon is in the form of graphite or carbon black.

6. The composite refractory stopper in claim 1 wherein the said means of conducting an electric current on the surface of the core is an electrically conductive coating.

7. The composite refractory stopper in claim 6 wherein the said electrically conductive coating is essentially composed of elemental carbon.

8. The composite refractory stopper in claim 7 wherein the said elemental-carbon is in the form of graphite or carbon black.

9. The composite refractory stopper in claim 7 wherein said electrically conductive coating includes a bonding material that positively affixes said electrically conductive coating to the surface of said refractory core at temperatures less than 950 degrees Fahrenheit and continues to affix said electrically conductive coating to the surface of said refractory core at temperatures above 950 degrees Fahrenheit.

10. The composite refractory stopper in claim 9 wherein said bonding material positively affixes said electrically conductive coating to the surface of said refractory core such that said bonding material does not surround said elemental carbon, individually or in the aggregate, in said electrically conductive coating thereby allowing said elemental carbon to make electrical contact with a separate electrically charged element in the system.

* * * * *